US005244563A

United States Patent [19]

Langenskiöld et al.

[11] Patent Number: 5,244,563

[45] Date of Patent: Sep. 14, 1993

[54] APPARATUS AND METHOD FOR ELECTROPLATING

[76] Inventors: Carl G. Langenskiöld, Riddargatan 54, S-114 57 Stockholm; Stefan Olin, Klubbacken 59, S-126 Hagersten; Mats A. Hallberg, Jupitervägen 56, S-181 63 Lidingö, all of Sweden

[21] Appl. No.: 838,556

[22] Filed: Feb. 19, 1992

[30] Foreign Application Priority Data

Feb. 20, 1991 [SE] Sweden ..... 9100507

[51] Int. Cl.[5] ..... C25D 1/10; C25D 17/00

[52] U.S. Cl. ..... 205/68; 204/224 R

[58] Field of Search ..... 205/68; 204/224 R

[56] References Cited

FOREIGN PATENT DOCUMENTS 0020008 4/1980 European Pat. Off. .
0076569 9/1982 European Pat. Off. .
0368372 10/1989 European Pat. Off. .
2011305 10/1971 Fed. Rep. of Germany .
2127851 9/1983 United Kingdom .

*Primary Examiner*—T. M. Tufariello

[57] ABSTRACT

An apparatus for electroplating, particularly in the production of metal matrices for manufacturing articles of plastic, such as compact discs, said apparatus comprising a container having a peripheral wall and opposed first and second end walls so as to form a plating space therein, adapted to house an electrolyte, and an anode, a carrier with an electrically conductive surface to be plated forming the cathode and means being arranged between the anode and the cathode for providing a flow of electrolyte from said cathode towards said anode. For allowing a faster production of metal matrices with better quality it is suggested according to the invention that the peripheral wall is formed with an internal contour which substantially corresponds to the surface to be plated, said carrier forming the second container end wall which through intermediate current supply members is sealingly urged against the mating edge of the peripheral wall, while the anode is located adjacent said first end wall of the container.

5 Claims, 1 Drawing Sheet

APPARATUS AND METHOD FOR ELECTROPLATING

Figure 1:
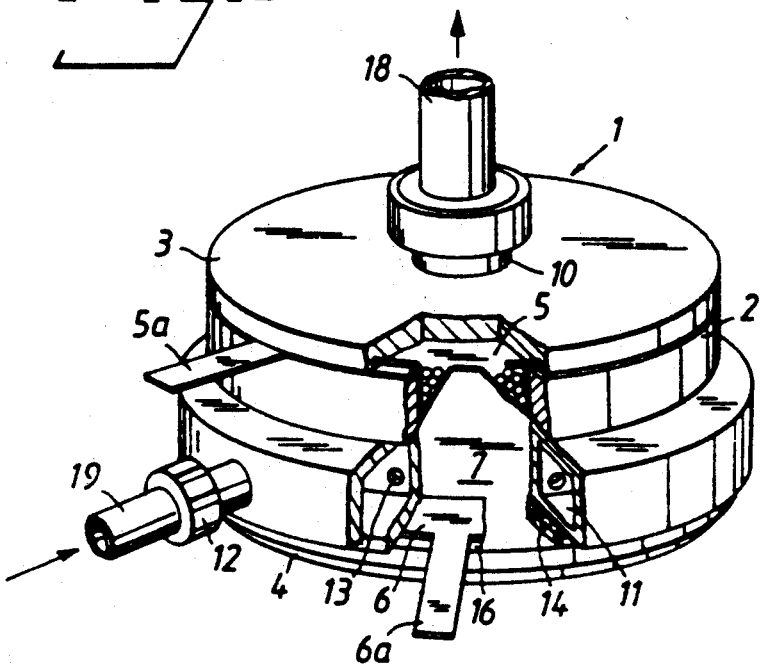

The invention relates to an apparatus for electroplating, particularly in the production of metal matrices for manufacturing articles of plastic, such as compact discs, said apparatus comprising a container having a peripheral wall and opposed first and second end walls so as to form a plating space therein, adapted to house an electrolyte, and an anode, a carrier with an electrically conductive surface to be plated forming the cathode and means being arranged between the anode and the cathode for providing a flow of electrolyte from said cathode towards said anode.

From EP-A-0 020 008 is known an apparatus of this type for electroplating metal matrices particularly with nickel. This known apparatus comprises a plating container, a storage tank for electrolyte, in principle usually nickel sulphamate, a cathode, an anode, filter means and pumping means. In the container one or more anode baskets are submerged, which contains the anode material preferably in the form of nickel spheres. The cathode having a discshaped plating surface is mounted in register with the anode and is rotated in the electrolyte, so as to make the metal precipitated to be uniform. Usually, the anode basket and hence the cathode surface are arranged inclined to the horizontal plane.

For a fast carrying-out of the plating operation it is desireable that the current density is high, but at high current densities crystals are liable to form, which protrude from the plating surface, whereby the metal matrix will be unusable.

Another problem in electroplating for producing stamper matrices of nickel is that the nickel layer must be built-up so as to be entirely free of mechanical stresses.

A further problem is that the matrix produced must have a very exact thickness, for instance 0.300 mm, and be totally plane-parallel.

Furthermore, a disadvantage of prior apparatus is that a large volume of electrolyte is required and usually the storage tank has a volume of about 400 liters. Moreover, the electrolyte has to have a temperature of 50°-60° C. and since the plating container is covered only by a lose cover large evaporation of water takes place. Since the cathode is rotatably mounted in the known apparatus, said cathode must be equipped with special contact means, which, due to the corrosive environment and the large current intensities transmitted, are liable to cause contact problems. Also, the cathode surface is more or less inclined and remaining hydrogen bubbles at the cathode surface cause the formation of small cavities therein, so called pittings. The cathode surface is considerably larger than the matrix later to be punched, and therefore the current consumption become larger than it actually need to be. The electrolyte outlet from the known plating container is formed as a simple spillway, which makes all impurities originating from the consumed anode material to remain in the container and affect the quality of the matrix produced.

Therefore, the object of the invention is to provide an apparatus for electroplating, particularly in the production of metal matrices for manufacturing articles of plastic, such as compact discs, by which apparatus metal matrices can be produced faster and of considerably improved quality.

According to the invention this object is achieved in that the peripheral wall is formed with an internal contour which substantially corresponds to the surface to be plated, said carrier forming the second container end wall which through intermediate current supply members is sealingly urged against the mating edge of the peripheral wall, while the anode is located adjacent said first end wall of the container.

Owing to the fact that the peripheral wall of the container has a cross-sectional area which substantially has the same size and form as the area of the plating surface and defines the same, the current density can be concentrated uniformly over the entire plating surface and no leak currents can appear at the peripheral edge of said plating surface. Also the restriction of the plating surface by the peripheral wall of the container results in that variations in concentration of the electrolyte might be avoided by the pumping of electrolyte into the container, which also gives the advantage that possible impurities released from the anode material, are positively removed from the plating space.

Also, the apparatus according to the invention requires a substantially smaller amount of electrolyte of about 50–70 liters, which is an advantage from both an economic and space-saving as well as heating point of view.

Since the container is totally closed, the plating can be made at a higher temperature than before without causing large evaporation problems.

Also, the apparatus according to the invention is particularly well suited for carrying out the plating by a new simplified method. This method according to the invention, in which a nickel layer is to be precipitated on a nickel matrix already produced, which has been introduced in the apparatus, is distinguished in that the nickel matrix, i.e. the cathode, for a short period of time is connected as anode for providing an oxide layer acting as a release layer, before the precipitation is commenced.

Figure 2:
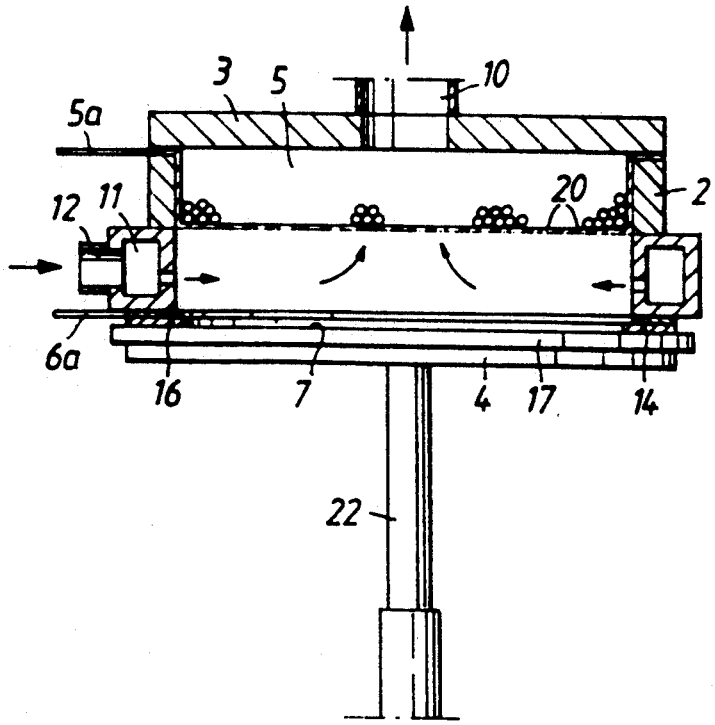

The invention will now be described by way of example with reference to the accompanying drawings, wherein FIG. 1 is a diagrammatical view, partly in section, of an apparatus according to the invention, and FIG. 2 is a central longitudinal section through the apparatus in FIG. 1.

In the drawings a container 1 for electroplating is shown comprising a peripheral wall 2 and end walls 3, 17 defining a plating chamber or space filled with electrolyte. Preferably, said container 1 is made of plastic such as polypropylene. An anode 5 is arranged at one of the end walls, in FIG. 2 the upper end wall 3, and a cathode is formed at the opposite end by a carrier 17 with a surface 7 to be plated, with a surrounding annular current supply conduit 6. The container 1 shown is intended particularly for producing metal matrices, preferably of nickel, for manufacturing planar articles of plastic, such as compact discs. The surface 7 to be plated is either a metallized information-carrying synthetic resin layer on a glass plate carrier 17 or a disc-like nickel layer being a copy of said synthetic resin layer in a subsequent manufacturing of mother and/or press matrices.

When the glass plate and the matrices have circular form the peripheral wall 2 in this case has a corresponding circular-cylindric shape, but if surfaces with another circumferential form are to be plated the peripheral wall 2 is given a corresponding contour, at least internally.

While one (upper) end wall 3 preferably is maintained stationary in a suitable way (not shown) together with the peripheral wall 2, the other end wall 17 is supported by a plate 4 which is axially movable to and fro the latter, preferably by any known mechanism, such as a piston-cylinder unit 22. Thus, in retracted position of the unit (open plating chamber) a glass plate carrier 17 with a metallized synthetic resin layer carrying information is placed on the plate 4 and thereafter by the unit 22 pressed sealingly against the edge of the peripheral wall 2, while inserting therebetween on one hand the annular current supply conduit 6 and on the other a contact ring 16, which surrounds the plating surface 7, together with necessary annular sealing means 14.

In the embodiment of the apparatus shown in the drawings the anode 5 is constituted by a basket, preferably made of titanium, containing metallic nickel in the form of spheres. By an upper outwardly-extending circumferential flange the basket is clamped between the peripheral wall 2 and the upper end wall 3 and depends into the container 1 with its plane bottom, which is provided with a plurality of holes 20, located at an exactly determined distance from the surface 7 to be plated and fully equidistant thereto. In this embodiment this distance amounts to 30 mm. Both the annular current supply conduit and the basket flange are provided with electric terminals 5*a* and 6*a*, respectively, for connection to any suitable known power source (not illustrated).

In its lower part the peripheral wall 2, is made hollow so as to form an electrolyte distribution channel 11 with a number of radially inwardly directed holes 13 equally angularly spaced around the circumference for providing a flow of electrolyte from the cathode towards the anode 5. Preferably, the holes 13 are directed obliquely at an angle of about 30° to the radius of the peripheral wall, as seen in a plane parallel to the surface 7 to be plated. Through a connection 12 the distribution channel 11 communicates with an electrolyte supply duct 19 from a circulation pump (not shown). In its turn, the upper end wall 3 is provided with a preferably central outlet opening 10, which through a duct 18 is connected to an electrolyte tank (not shown), to which the circulation pump is connected. The cross-sectional area of the opening 10 preferably is adapted to the total area of the inlet holes 13 and the pump pressure such that a suitable over-atmospheric pressure of 0.1–10 bar, and particularly 0.5 bar, can be maintained within the container 1 during the plating process. In this way it can at the same time be ensured, that the father or mother matrix placed on the plate 4 is held absolutely plane, so that also the precipitated matrix will be completely plane. Moreover, filter means may be provided at both the inlet and outlet of the container 1, so that the liquid in the storage tank and the rest of the system is kept free from impurities. Although not illustrated in the drawings, the end wall 3 is separable from the peripheral wall 2 for replenishment of anode material.

In another embodiment (not shown) of the invention another type of anode is used, namely a dimensional-stable disc-like anode, a so called DSA, of for instance platinum-coated titanium, which can be provided with a plurality of holes. When using this anode replenishment means are arranged at the storage tank for compensation of nickel precipitated from the electrolyte. This can be done by adding e.g. nickel hydroxide. When the dimensional-stable anode is used the distance between the cathode and the anode can be still more reduced, down to e.g. 5 mm, whereby higher current densities may be used and hence faster precipitation of nickel can be achieved. Also, considerably less electrical effect is consumed with shorter distance between the anode and the cathode. In such case, the electrolyte outlet 11 is preferably arranged in the peripheral wall 2.

As seen from the above mentioned the embodiment of the apparatus shown in the drawings is intended to be used with the plating surface 7 in horizontal position, while the lastmentioned embodiment (not shown) can be used with the surface 7 to be plated also in vertical position, which in certain cases can be of practical advantage.

As mentioned, the apparatus according to the invention is particularly well suited to be used in connection with a simplified method for plating, which now is to be described. In doing so, a glass plate carrier 17 carrying a metallized resin layer provided with information is initially placed on the plate 4 in the retracted opened position thereof, after which the end wall is closed in the above-mentioned manner, whereupon electrolyte is fed into the plating space and the power supply is turned on for carrying out a first plating or precipitation of a nickel layer on the resin layer. When this nickel layer has reached necessary thickness the plating is stopped and the carrier with the nickel layer is removed from the container 1. Thereafter, the nickel layer, which now forms a so-called father matrix for subsequent manufacture, is peeled off from the resin layer and the side thereof carrying information is de-polymerized, washed with e.g. acetone and rinsed with de-ionized water.

Then, the father matrix is ready to be placed in its turn on the plate 4 and introduced in the plating space for precipitation thereon of a further "inverted" matrix, a so-called mother matrix. Contrary to prior art the necessary passivation of the father matrix before this further plating is not done by treating with chromate compounds but by, in accordance with the invention, first coupling the cathode in a short time period of 0.1–60 seconds, preferably 3–20 seconds, as anode, thereby producing a thin oxide layer acting as release layer, before carrying out the subsequent plating. Then the cathode is re-coupled and the precipitation of the mother matrix is carried out.

After removal from the container and separation from the father matrix, this mother matrix then can be directly placed again on the plate 4 and used for precipitation of one or several so-called press matrices, in the same way.

With the apparatus according to the invention the manufacturing time for press matrices can be dramatically reduced, and without use of environmental hostile chromate baths for passivating the matrices, as the case is in prior art. This is very advantageous since chromates are poisonous and require very vigorous handling rules. The metal matrices produced by the invention have great surface smoothness even on its back side and therefore seldom need to be subjected to any mechanical post-machining.

The apparatus according to the invention can be used for producing all types of optical information carriers of compact disc type, such as CD, CD-DA, CD-ROM, CD-V, CD-I, Laser Discs, but also in producing vinyl-discs, holograms etc.

Also, with the apparatus according to the invention the thickness of the produced matrix can be made to vary in radial direction, such that the precipitated matrix is thicker in the center, which is an advantage in connection with subsequent injection moulding. This is achieved by suitable reduction of the area of the plating space, e.g. in that the peripheral wall 2 is manufactured with a slight inwardly convex shape or in that the distribution channel 11 is given a form such that it screens the peripheral edge of the plating surface to a desired extent.

We claim:

1. An apparatus for electroplating in the production of metal matrices for manufacturing articles of plastic, said apparatus comprising a container (1) having a peripheral wall (2) and opposed first and second end walls so as to form a plating space therein, adapted to house an electrolyte, and an anode (5), a carrier (17) with an electrically conductive surface (7) to be plated forming the cathode and means (13) being arranged between the anode (5) and the cathode for providing a flow of electrolyte from said cathode towards said anode (5), characterized in that: corresponds to the surface (7) to be plated, said carrier (17) forming the second container and wall which through intermediate current supply members (6, 16) is sealingly urged against the mating edge of the peripheral wall (2), while the anode (5) is located adjacent said first end wall (3) of the container (1).

2. Apparatus according to claim 1 having an anode made of nickel, characterized in that the anode (5) is constituted by a basket having a planar bottom and being filled with nickel spheres, the surface (7) to be plated being horizontally orientated and parallel with the bottom of the basket and the second end wall (3) being provided with at least one electrolyte outlet (10).

3. Apparatus according to claim 1, characterized in that the anode (5) is a dimensionally stable disc anode, a so called DSA, and by devices for replenishment of nickel precipitated from the electrolyte, electrolyte outlets (10) preferably being arranged in the peripheral wall (2).

4. Apparatus according to claims 1–3, characterized in that the electrolyte is pressurized in the container (1).

5. A method for electroplating in the production of metal matrices for manufacturing articles of plastic, such as compact discs, while using an electroplating apparatus, in which method a nickel layer is to be precipitated on a nickel matrix already manufactured and introduced in the apparatus, characterized in that the nickel matrix, for a short time period is connected as an anode for providing an oxide layer acting as release layer before the precipitation is started.

* * * * *